US005524912A

United States Patent [19]

Laub et al.

[11] Patent Number: 5,524,912

[45] Date of Patent: Jun. 11, 1996

[54] ALL SEASON SKATE

[76] Inventors: Michael J. Laub, 43 Evergreen Rd., Dellwood, Minn. 55110; Craig C. Wannous, 4001 Overlook Dr., Bloomington, Minn. 55437

[21] Appl. No.: 242,506

[22] Filed: May 13, 1994

Related U.S. Application Data

[63] Continuation-in-part of Ser. No. 25,033, Mar. 1, 1993, Pat. No. 5,393,077.

[51] Int. Cl.[6] ..... A63C 17/18

[52] U.S. Cl. ..... 280/7.13; 280/11.22; 280/11.27; 280/600

[58] Field of Search ..... 280/7.13, 7.14, 280/7.12, 7.1, 11.22, 11.27, 600, 9, 10

[56] References Cited

U.S. PATENT DOCUMENTS

| | | | |
|---|---|---|---|
| 2,868,553 | 1/1959 | Ricckman | 280/7.13 |
| 2,874,970 | 2/1959 | Mall | 280/7.13 |
| 3,351,353 | 11/1967 | Weitzner . | |
| 4,026,045 | 5/1977 | Druss . | |
| 4,150,499 | 4/1979 | Wang . | |
| 4,188,046 | 2/1980 | Fleckenstein . | |
| 4,492,385 | 1/1985 | Olson . | |
| 4,666,169 | 5/1987 | Hamill et al. . | |
| 4,836,571 | 6/1989 | Corbisiero | 280/600 |
| 4,932,675 | 6/1990 | Olson et al. . | |
| 5,127,672 | 7/1992 | Horibata . | |
| 5,193,839 | 3/1993 | Hannes . | |
| 5,257,793 | 11/1993 | Fortin | 280/7.13 |
| 5,314,199 | 5/1994 | Olson et al. | 280/7.13 |

FOREIGN PATENT DOCUMENTS

| | | |
|---|---|---|
| 376068B | 12/1989 | European Pat. Off. . |
| 1943298 | 8/1969 | Germany . |
| 587297 | 4/1947 | United Kingdom . |

OTHER PUBLICATIONS

SnowRunner brochure, SnowRunner (USA) Inc., 1993.

*Primary Examiner*—Kevin T. Hurley
*Attorney, Agent, or Firm*—Dorsey & Whitney

[57] ABSTRACT

The skate of the present invention includes a foot receiving boot having a substantially rigid shell and sole. A frame is fixedly attached to the sole and includes a forward frame portion and a rear frame portion. The frame, and thus the boot, is adapted to receive interchangeably a wheeled truck for in-line roller skating, a blade carrying truck for ice skating, and a ski assembly for use on snow. The ski assembly includes a ski member and an adapter wherein the adapter is releasably attached to the boot and the ski is releasably connected to the adapter. The adapter includes a bottom surface that facilitates walking when the ski is removed. In another embodiment, each of the wheeled truck, the blade carrying truck and the ski have an integral mounting structure complimentary to the frame and are removably attached directly to the boot.

8 Claims, 9 Drawing Sheets

ALL SEASON SKATE

RELATED APPLICATION

This application is a continuation-in-part of application Ser. No. 08/025,033, filed Mar. 1, 1993 now U.S. Pat. No. 5,393,077.

TECHNICAL FIELD

The present invention relates to skates. In particular, it relates to an "in-line" type of training or recreational convertible skate for use in any season wherein the skate interchangeably carries wheels, a bladed truck or a ski.

BACKGROUND OF THE INVENTION

Skating has been a well known and popular form of recreation for a long time. Traditionally, it was a seasonal activity performed with a blade carrying skate on ice in winter and with a wheeled skate on smooth paved surfaces in warm weather, but rink facilities creating artificial conditions enabled people to ice skate in warm weather and roller skate in winter. Separate bladed or wheeled skates were still required.

The next development was a shoe or boot adaptable to carry interchangeably a blade or plurality of wheels or rollers. Such skates are represented by the skate or skate devices disclosed in U.S. Pat. Nos. 3,351,353 (Weitzner) and 4,666,169 (Hamill et al.). The Hamill et al. skate apparatus requires a bifurcated truck assembly which must be disconnected from the sole of the shoe and disassembled to switch between wheels and the optional ice skate attachment. The Weitzner patent is directed to a skating shoe with retractable, interchangeable blades, rollers or jump springs. The shoe has a thick sole with a central longitudinal channel having an open rear end and a closed front end. A plate member supporting the springs, rollers or blade is retractably received in the channel and, when retracted, can be covered by a separate plate so that the shoe can be used for walking with a flat sole and heel. There is no disclosure or suggestion in either the Weitzner or Hamill et al. patent about how to provide an interchangeable ski structure for skating on snow.

Two other patents disclosing the concept of interchangeability in skate devices are U.S. Pat. Nos. 4,150,499 (Wang) and 5,127,672 (Horibata). The latter patent discloses a hopping roller skate for the training of skiing wherein the shoe can function in its usual manner when separated from the roller structure. However, the shoe would be unsuitable for substantially normal walking to and from a place of use. While the Wang shoe might be used for normal walking after the blade or rollers are removed, a disadvantage is that it is a sandal type shoe and provides no or very limited support for a user's ankles. Neither Wang or Horibata suggest that a ski could be interchangeably connected to the respective shoes.

U.S. Pat. No. 4,492,385 (Olson) and 4,932,675 (Olson et al.) disclose skates having an interchangeable operative portion, a blade or wheel assembly, fastened to a shoe or boot. Frame members are attached to the sole of the boot and have relieved regions or recesses on each side for receiving beams or edge portions associated with the interchangeable blade or wheel assemblies. There is no disclosure or suggestion in either patent about how a ski could be releasably or interchangeably connected to the shoe or boot.

U.S. Pat. Nos. 4,188,046 (Fleckenstein) and 5,193,839 (Hannes) disclose ski and boot arrangements for snow skating or fancy skiing. The ski disclosed in the former patent includes an integral boot plate and a fairly typical ski binding toe piece and releasable heel binding. The ski is relatively short, being intended for "hot dogging" or trick skiing. The Hannes winter sports equipment is designed for skating and ordinary walking by providing an integral structure formed by a sole plate closely associated with a boot upper. Neither patent discloses or suggests how such a ski and boot arrangement could be adapted for use as a roller skate or ice skate.

It would be advantageous if a convertible sport and training skate could be provided for use in any season, wherein the skate could be adapted to become a roller skate, an ice skate or a snow skate.

SUMMARY OF THE PRESENT INVENTION

The convertible skate of the present invention includes a foot receiving boot having a substantially rigid upper shell and sole. A frame is fixedly carried by the sole and includes a forward frame member and a rear frame member formed integrally with or attached permanently to the sole and heel of the boot. The boot, and thus the skate, is adapted to receive selectively and interchangeably wheels for in-line roller skating, a blade for ice skating, and a ski for use on snow.

In one embodiment, the wheels, blade and ski include an integral "truck" (i.e., a body supporting the wheels or axles therefor, the blade or the ski), including mounting structure complementary to the frame carried on the boot. The mounting structure includes front and rear mounting structures each having an uppermost surface, opposite sides, front and rear ends and an elongated relieved groove region on each side for slidably receiving facing outstanding tongue portions of the frame.

In another embodiment, a ski assembly is used to form the snow skate configuration. The ski assembly includes a ski member and an adapter wherein the adapter is releasably attached to the boot and the ski is releasably connected to the adapter. The adapter includes a bottom surface that facilitates walking to and from a place of exercise when the ski is removed.

With further regard to the support truck, it comprises an elongate subassembly including a molded polymeric body with a lower portion attached to or formed integrally with the ice blade, the axles for the wheels or the top of the ski. The truck has spaced front and rear outstanding mounting structure portions each having opposed spaced side walls with recessed areas. In the ski assembly embodiment, the removable adapter subassembly is elongated and generally bone-shaped. The front and rear portions carry forwardly and rearwardly extending tongues, respectively, and a narrow medial finger-receiving grip area extends therebetween. The front and rear mounting structure portions of the wheel, blade and ski trucks and the front and rear portions of the adaptor can be releasably attached to the attachment frame members carried by the boot in a tongue and groove arrangement. A fastener is provided for locking the subassemblies, i.e., the wheel carrying truck, the blade carrying truck, the ski carrying truck or the ski assembly, on the boot.

The present invention is designed specifically to enable skating in any season and to facilitate cross-training for athletes. It enables outdoor skating in winter or summer, on ice or snow, and improves the stability and performance of the skate when being used in any of its modes.

The convertible skate of the present invention is easy to use in any season. In the snow skate configuration, i.e., when adapted for use in winter, the ski of the ski assembly embodiment can be detached easily so that the user can walk normally to and from the place of use (on the adapter) without damaging the snow-contacting surface of the ski. In the embodiment wherein the ski has an integral mounting structure and is semi-permanently yet removably mounted on the skate boot, it is intended the user will not walk to the place of use on the ski, but will put the skates on only at the place of use, much the way typical skis and ski boots are used.

An object of the present invention is to provide a convertible recreational and training skate for use in any season.

Another object of the present invention is to provide a skate including a ski assembly, wherein the ski assembly comprises a ski member and an adapter, and further wherein the adapter facilitates the convenient attachment and removal of the ski and provides a ribbed walking surface.

Yet another object of the present invention is to provide a convertible skate including a boot having a sole carrying a mounting frame. The skate further includes a wheel carrying truck, a blade carrying truck and a ski carrying truck, each including a mounting structure complimentary to the mounting frame carried by the boot. The wheel carrying truck, blade carrying truck and ski carrying truck may be selectively and interchangeably mounted on the boot so that the skate may be used respectively as a roller skate, an ice skate or a snow skate.

The skate of the present invention is easily convertible to a wheeled roller skate, a bladed ice skate and a ski snow skate, and facilitates cross-training and recreational enjoyment in any season, particularly for in-line skaters.

DETAILED DESCRIPTION OF THE INVENTION

The FIGS. depict a convertible skate 20 in accordance with the present invention. Although only a single boot, and associated set of wheels, blade or ski is depicted, it should be understood that the skate of the present invention comprises a pair of substantially identical skates and attachments, one for each foot of a user.

Figure 1:
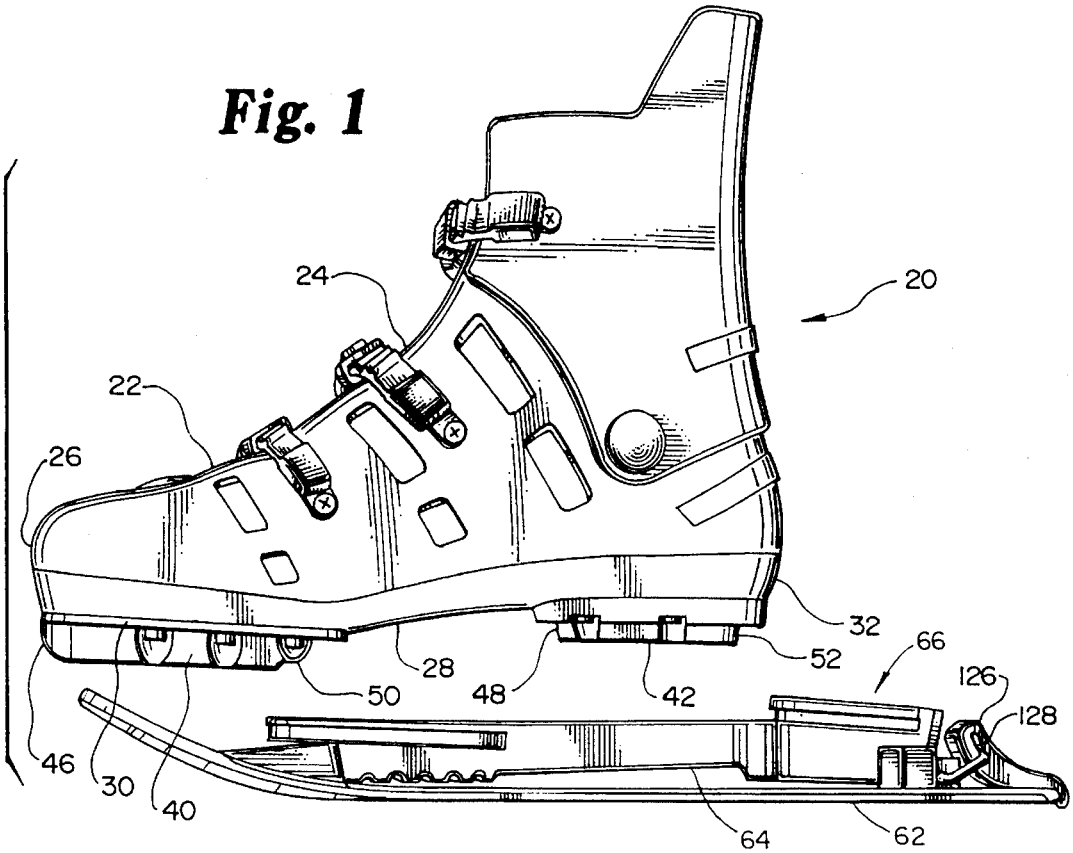
FIG. 1 is a side elevation view of the convertible skate of the present invention with the ski assembly ready to be mounted on the boot.
Figure 11:
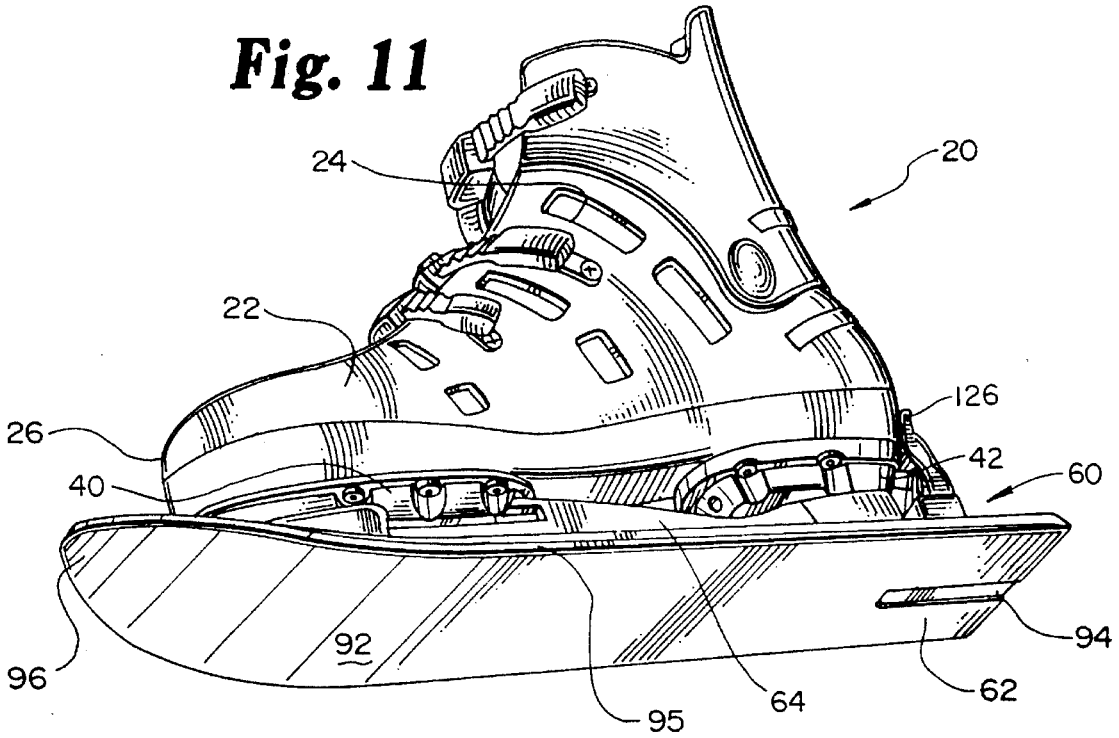
FIG. 11 is a perspective view showing the ski assembly mounted on the boot ready for use and also shows the vertical separation between the sole of the boot and the ski and the horizontal separation between the toe of the boot and the tip of the ski.

Referring to FIGS. 1 and 11, the skate 20 includes a boot 22 having an upper vamp section 24, a lower vamp section 26 and a sole 28. The sole includes a front ball receiving area 30 and a rear heel area 32. The lower vamp section 26 extends generally upwardly from the sole to provide support for the lower foot area. The upper vamp section 24 includes a typical opening to receive a user's foot. The boot 22 may be molded of appropriate materials including various plastics.

Figure 3:
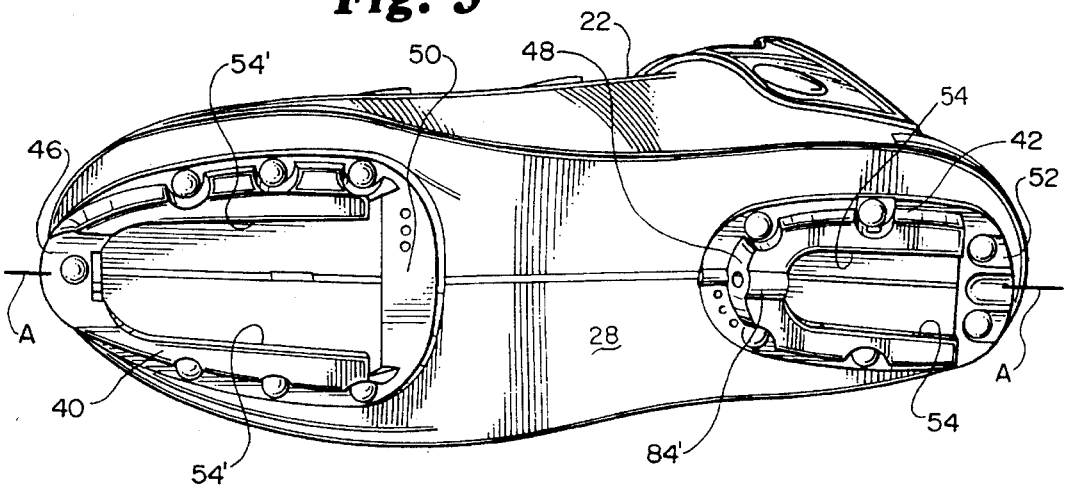
FIG. 3 is an elevational view of the frame members on the sole and heel of the boot of the present invention.

Referring to FIGS. 1 and 3, the sole 28 of the boot 22 permanently carries or includes a frame comprising front and rear attachment frame members 40, 42, respectively. The frame members 40, 42, specifically the peripheries thereof, generally follow the foot or sole profile of the boot 22 to provide better responsiveness and performance when a ski, skate or blade is installed. Each frame member 40, 42 includes a front end 46, 48, respectively, a rear end 50, 52, respectively, and opposite sides extending between the front and rear ends. The rear frame member 42 has a generally parallel, inwardly facing edges 54 which extend parallel with the longitudinal center line of the boot, represented by line A in FIG. 3. Similarly, the front frame member 40 has edges 54' but, toward the front of the boot, the edges 54' curve or angle toward each other.

Figure 4:
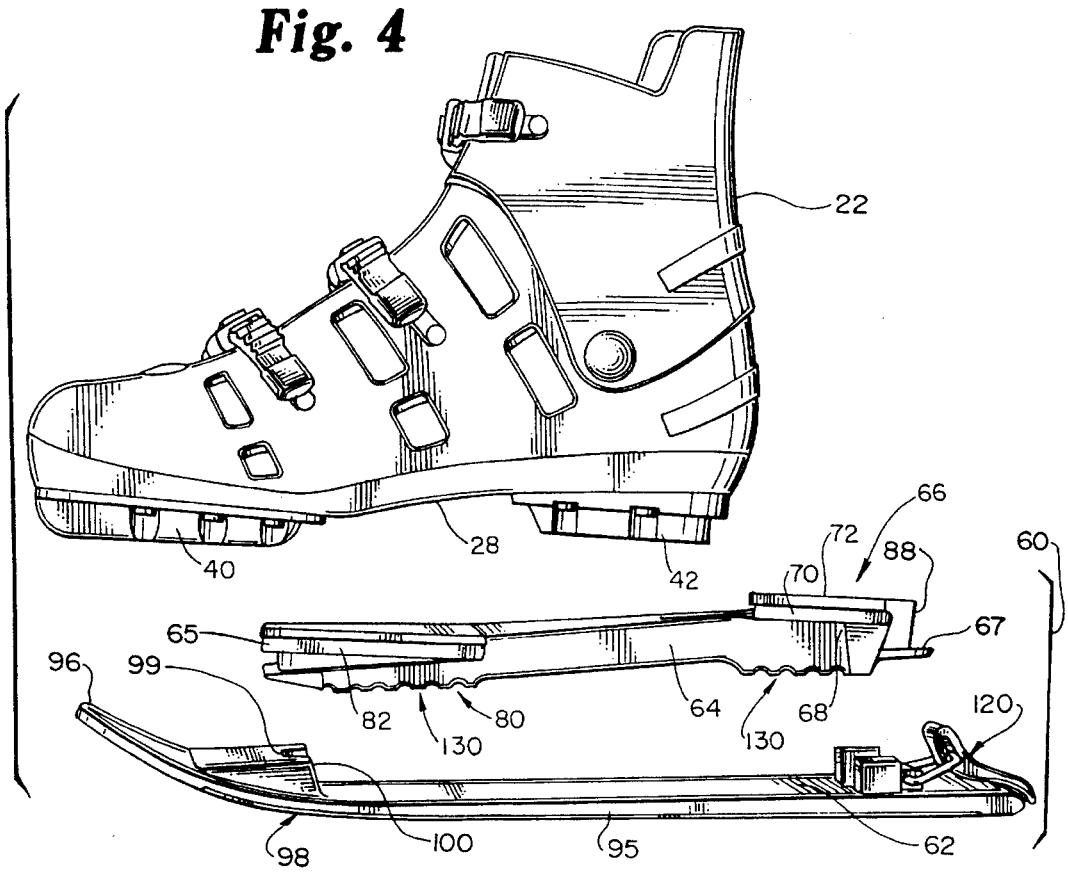
FIG. 4 is an elevational view of the skate of the present invention including the boot and the ski assembly, and depicts an initial step in the connection of the ski assembly to the boot.
Figure 7:
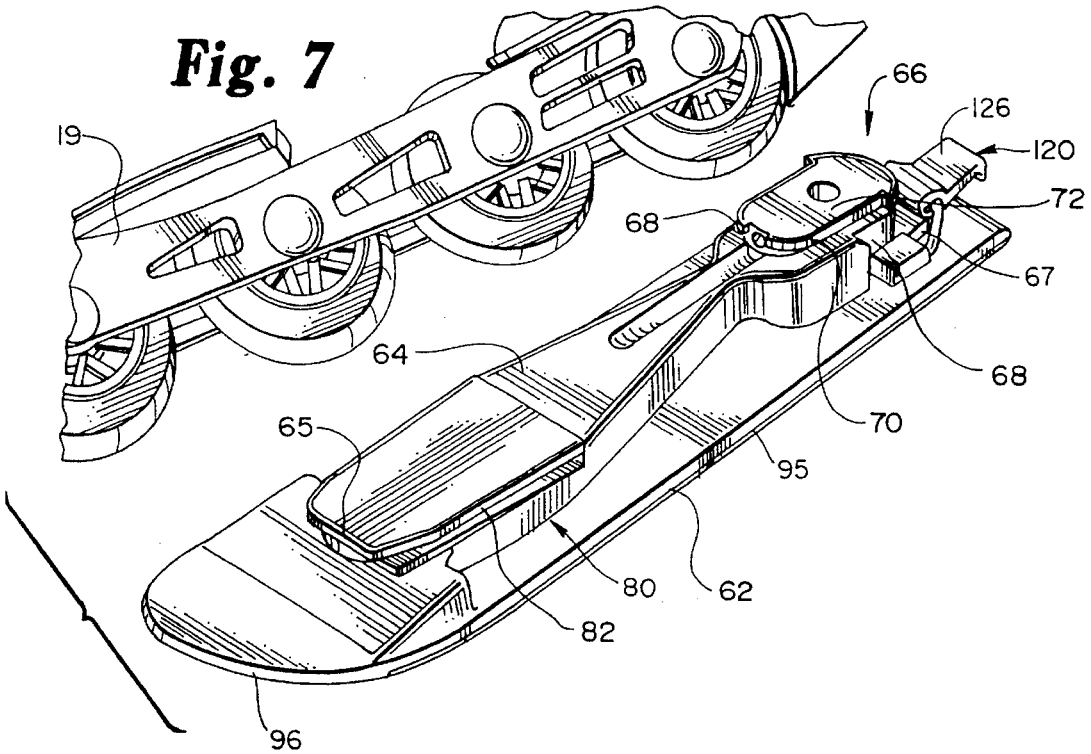
FIG. 7 is a perspective view of the uppermost boot contacting surface of the adapter of the present invention and shows the ski member partially connected to the adapter.

Referring to FIGS. 4 and 7, the skate of the present invention includes an interchangeable ski assembly 60 including a ski 62 and an adapter 64. The adapter 64 includes attachment means for releasably engaging the front and rear frame members 40, 42 on the sole 28 of the boot 22. Specifically, the rear portion 66 of the adapter 64 includes a rear flange 67 and opposed sidewall portions 68, each having a groove 70 along its outer surface. The grooves 70 are defined by upper and lower opposed surfaces and innermost recessed surfaces, and are generally parallel to the adapter upper surface 72.

The inside edges 54 of the rear attachment frame member 42 are adapted to enter the grooves 70 wherein they are closely engaged and whereby the rear 66 of the adapter 64 is held close to the heel area of the sole 28 of the boot 22.

The adapter 64 includes a front portion 80 carrying a front tongue 65 and opposed grooves 82 on the outside edges thereof. The grooves 82 are adapted to receive the side edges 54' of the front attachment frame member 40.

Figure 2:
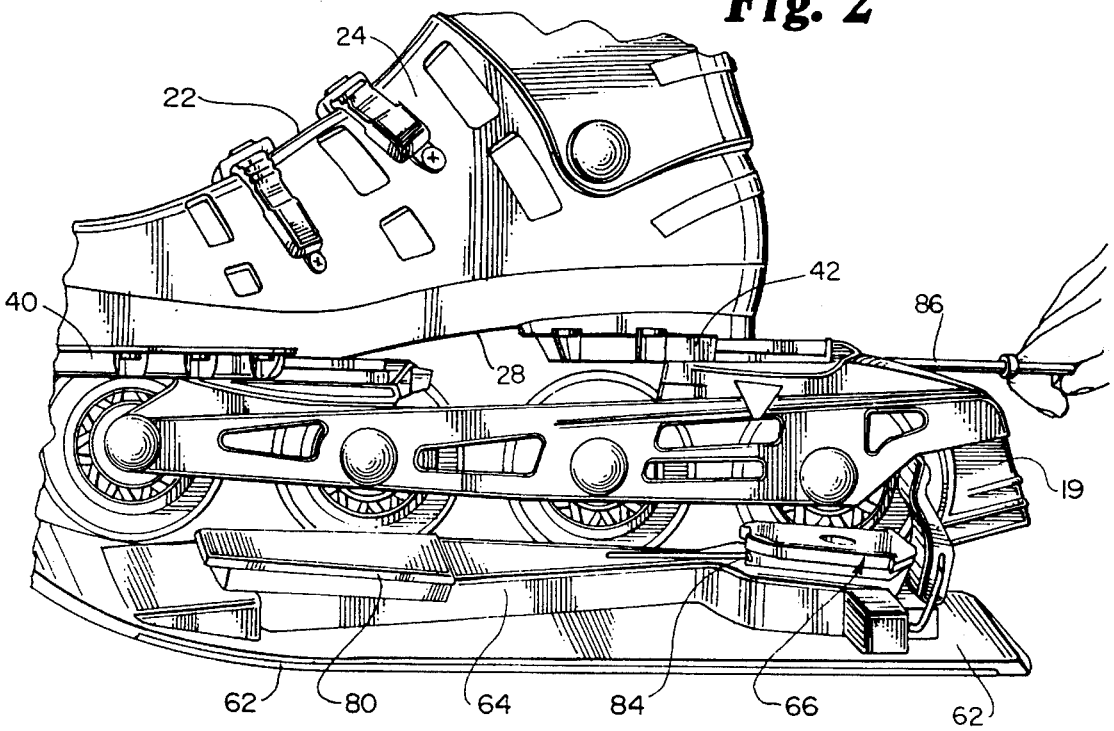
FIG. 2 is an elevational view of the skate depicting the removal of the in-line wheeled truck, and including, in the foreground, a perspective view of the ski assembly embodiment of the present invention.

Referring to FIG. 2, 3 and 4, fastening means are provided to retain the adapter 64 in the front and rear frame members 40, 42. The rear portion 66 of the adapter 64 and the front of the frame member 42 include a threaded portion 84 and 84', respectively, for receiving a fastening member 86 such as an allen-headed bolt.

The bolt 86 is inserted in a rear opening 88 and, as depicted in FIG. 2, a tool or allen wrench may be used to engage the bolt 86 with the threaded portions 84, 84' to securely fasten the adapter 64 in place relative to the boot 22. Similar fastening structure may be provided for and used with the wheel and blade trucks.

Referring to FIGS. 7 and 9–11, the present invention includes a ski 62. The ski includes a typical, generally planar bottom surface 92 (shown in FIG. 11), including a rear steering channel 94 and an upturned, generally pointed tip 96. Steel side edges 95 may be provided.

Figure 9:
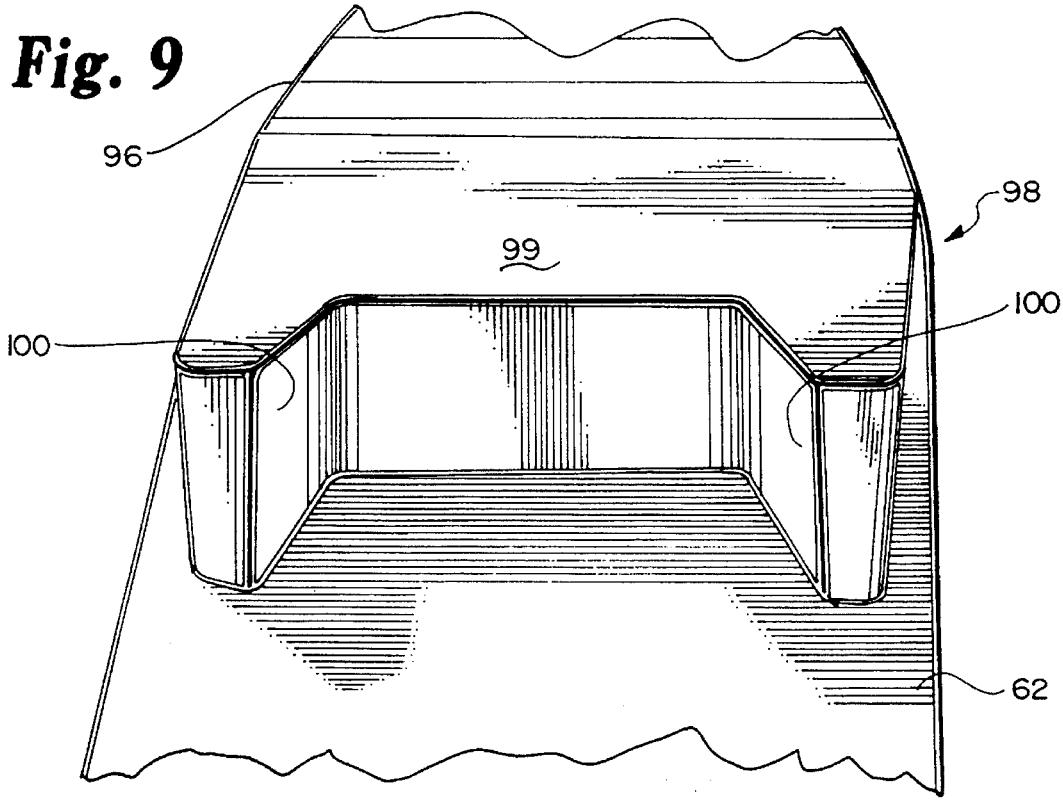
FIG. 9 is a detailed perspective showing the front mount of the ski of the ski assembly embodiment.

Referring specifically to FIG. 9, just rearwardly from the tip 96, the ski 62 includes a front tongue receiving shoulder 98 with a flange 99. The shoulder 98 receives the front tongue 65 of the adapter 64, and includes rounded side guide surfaces, both indicated at 100, for guiding the tongue 65 into alignment with the central longitudinal axis of the ski 62.

Figure 10:
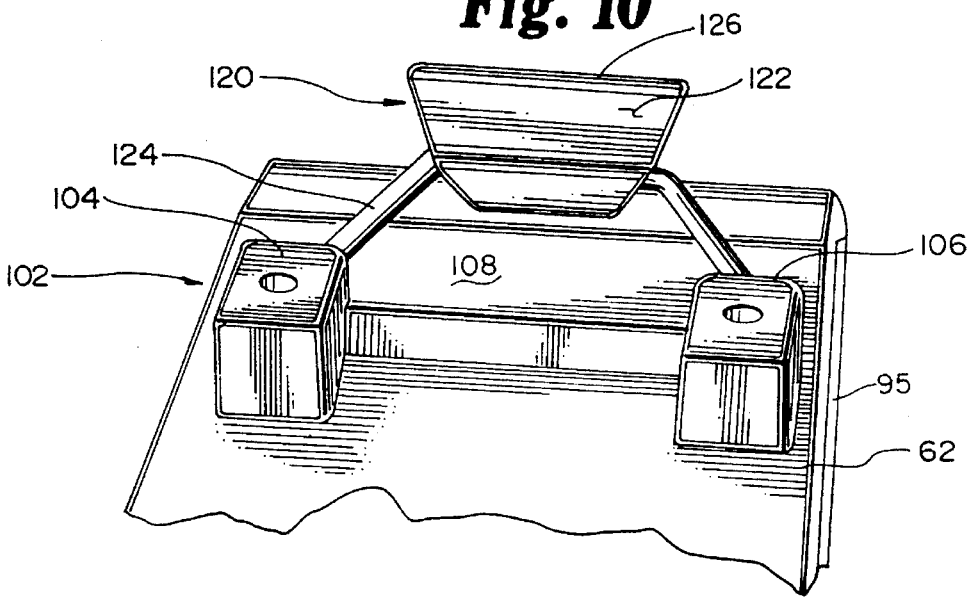
FIG. 10 is a detailed perspective showing the rear mount of the ski of the ski assembly embodiment.

The ski 62 includes a rear mounting shoulder 102 (FIG. 10). The rear shoulder comprises two spaced, generally rectangular upstanding side centering blocks 104, 106 and a flat-topped center table 108 extending generally perpendicularly between the blocks 104, 106 and transversely across the ski surface.

Figure 8:
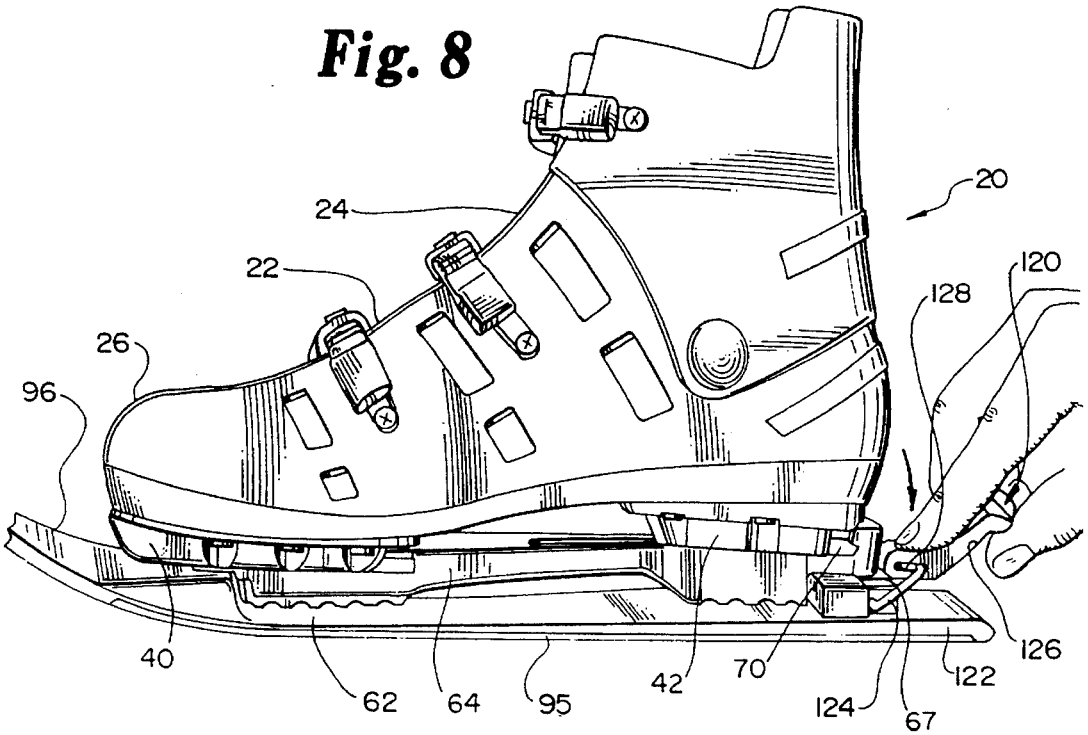
FIG. 8 is an elevational view depicting the ski of the ski assembly embodiment being locked into place on the boot for use.

The ski 62 carries a manually operable latch mechanism 120 (FIG. 10) to secure the ski 62 to the adapter 64 with the ski central longitudinal axis generally parallel to the central longitudinal axis of the adapter 64. The latch mechanism 120 comprises an eccentric camming mechanism 122 pivotally mounted on a wire-like bracket 124 pivotally connected to the center table 108. In use, when the ski 62 is positioned on the adapter 64, and the rear flange 67 of the adapter 64 is in contact with the center table 108, the camming mechanism 122 is pivoted to engage the flange 67 and to secure the ski 62 to the adapter 64 (as shown in FIG. 8). A handle 126 is provided on the cam mechanism 122 and the cam mechanism 122 includes a generally central rubberized resilient portion 128 so that it can be operated more easily and to bias it in place.

In use, the wheeled truck 19 (shown in FIGS. 2 and 7) is removed from the boot 22 of the present invention by loosening the allen-bolt 86 and sliding it rearwardly relative to the boot 22 as depicted in FIG. 2. The truck 19 is slid rearwardly and removed to open the front and rear mounting frames 40, 42 to receive the adapter 64 (FIGS. 3 and 4).

Figure 5:
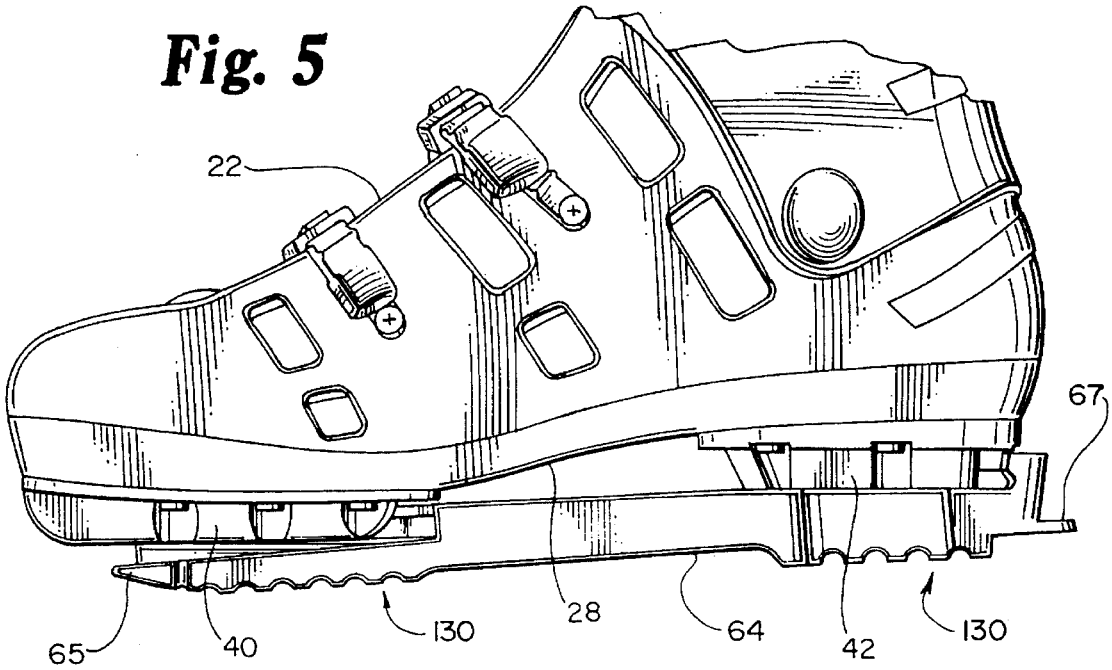
FIG. 5 is an elevational view of the adapter of the ski assembly of the present invention connected to the boot.
Figure 6:
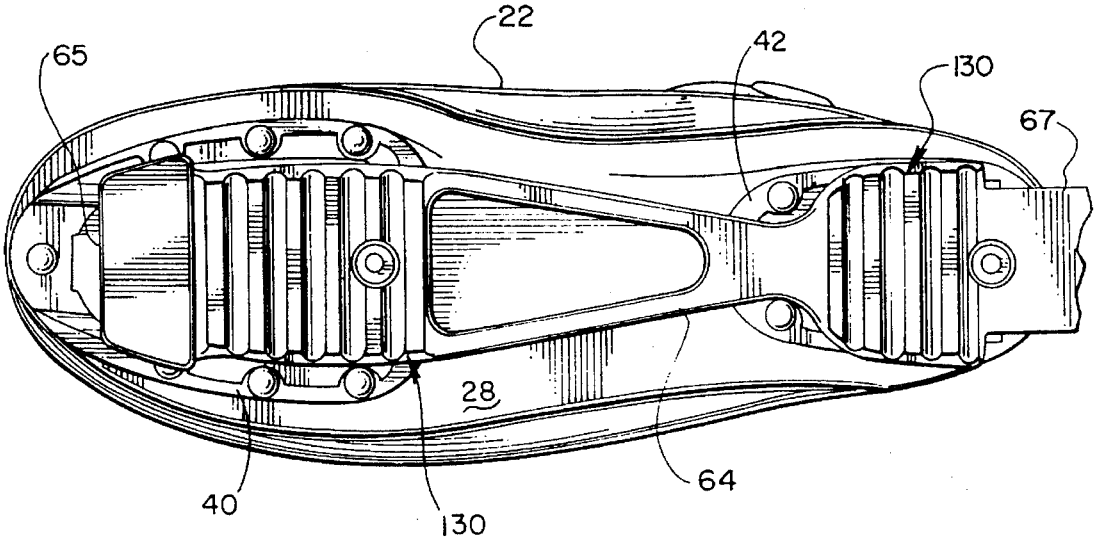
FIG. 6 is a bottom plan view of the walking surface of the adapter.

Next, the user may attach the ski assembly 60 to the boot 22. This is done with the adapter 64 initially separated from the ski 62 as depicted in FIG. 4, but it can be done with the ski 62 locked on the adapter 64. The adapter 64, particularly the front and rear attachment means thereof, is aligned with the edges 54', 54 of the front and rear mounting members 40, 42 of the boot. The adapter 64 is then pushed toward the toe end of the boot 22, the edges 54, 54' engaging the grooves 70, 82, and the allen bolt 86 is inserted in the aperture 88 at the rear end of the adapter 64 above the flange 67 and tightened to lock the adapter 64 to the boot 22. FIGS. 5 and 6 depict the adapter 64 in place on the boot 22.

To attach the ski 62, the tongue 65 of the adapter is inserted into the front mounting shoulder 98 of the ski 62 and the flange 67 at rear of the adapter is placed between the spacer blocks 104, 106 thereby aligning the longitudinal axes of the ski 62, the adapter 64 and the boot 22. The boot is lowered with respect to the ski until the flange 67 contacts the center block 108. The latch mechanism 120 can be manipulated as outlined above and as depicted in FIG. 8 to fully lock the ski 62 in place on the adapter 64. FIG. 11 shows the ski assembly and boot 22 fully assembled to form one embodiment of the snow skate of the present invention.

A particular advantage of the ski assembly embodiment (FIGS. 1-11) of the skate 20 of the present invention is that when the user is finished snow skating, the latch mechanism 120 can be released and the user may simply step away from the ski 62. The ribbed or textured bottom walking surface 130 of the adapter 64 (as shown in FIGS. 4, 5 and 6) enables the user to walk safely and in a generally normal walking motion away from the place of use or exercise. This ski removal feature avoids damaging the snow contacting bottom surface of the ski 62 and provides much more comfortable walking for the user.

Figure 12:
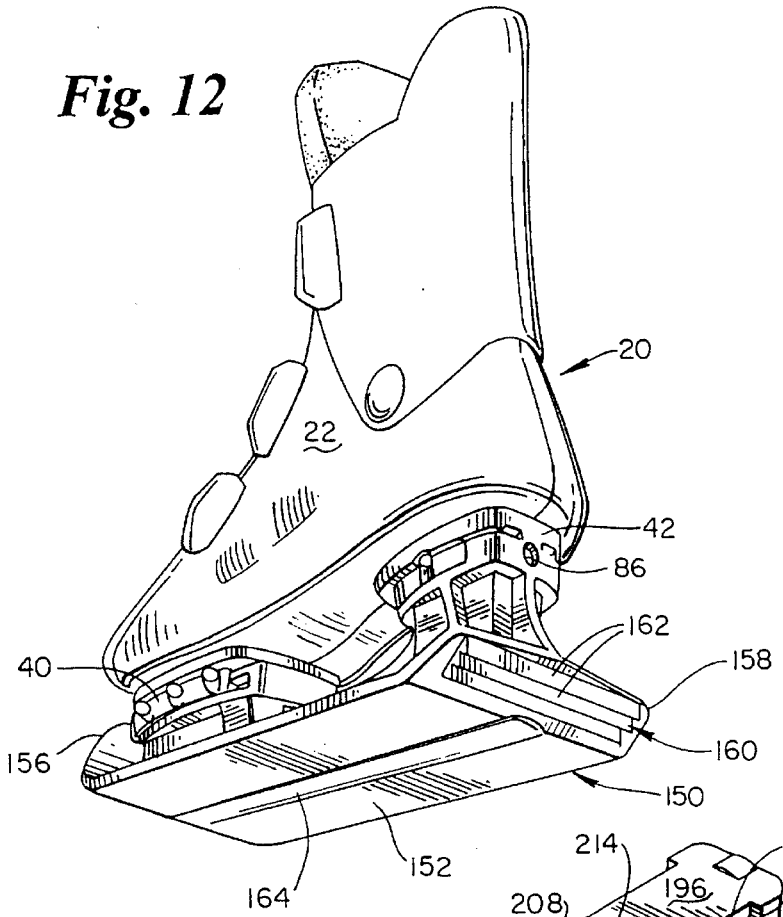
FIG. 12 is a rear perspective view depicting another embodiment of the present invention wherein a ski with an integral mounting structure (a "truck") is mounted on the boot to form the snow skate configuration of the present invention.
Figure 13:
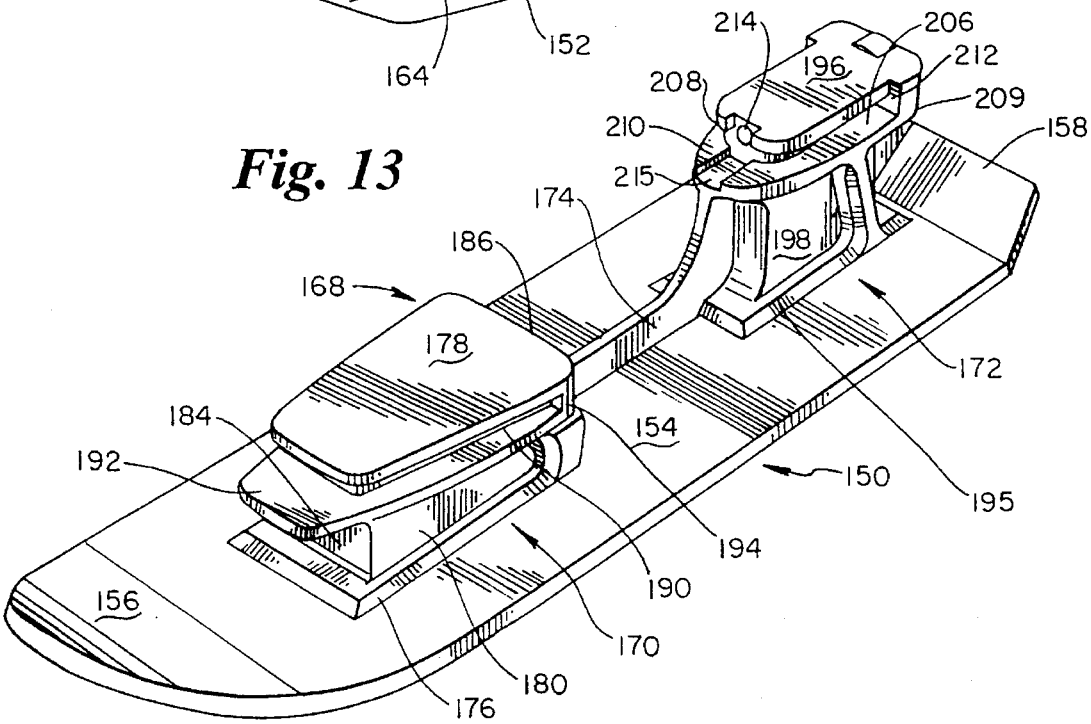
FIG. 13 is a perspective view depicting the mounting structure ("truck") associated with the ski.

FIGS. 12–16 depict another embodiment of the convertible snow skate 20 of the present invention, particularly a second type of ski 150 for converting the skate 20 to a snow skate. The boot 22 and the frame (comprising frame members 40, 42) carried on the sole and heel of the boot 22 are substantially identical to the boot 22 and frame depicted in FIGS. 1–11, and are commonly numbered. Referring to FIG. 12 and 13, the ski 150 has a generally smooth, flat snow-contacting runner bottom surface 152 and a top surface 154. The front tip 156 of the ski 150 is upwardly curved and generally bluntly pointed. The rear end portion 158 of the ski 150 is angled upwardly and includes an optional brake surface 160 comprising a plurality of parallel raised rib portions 162 extending transversely across the longitudinal axis of the ski 150. A generally central, elongated channel 164 to facilitate steering and control is provided on the runner bottom surface 152.

Figure 14:
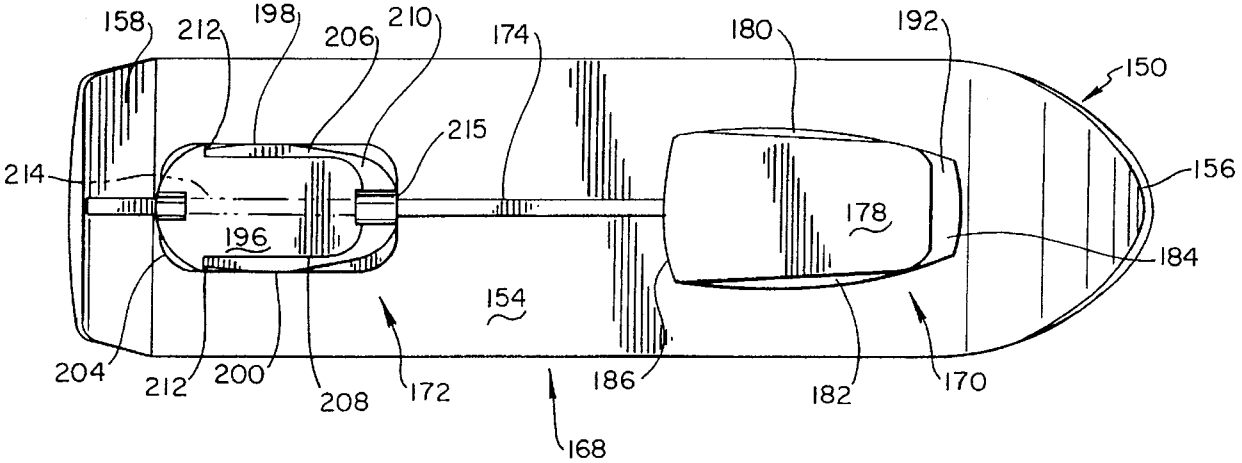
FIG. 14 is a top plan view of the ski with the integral mounting structure.
Figure 15:
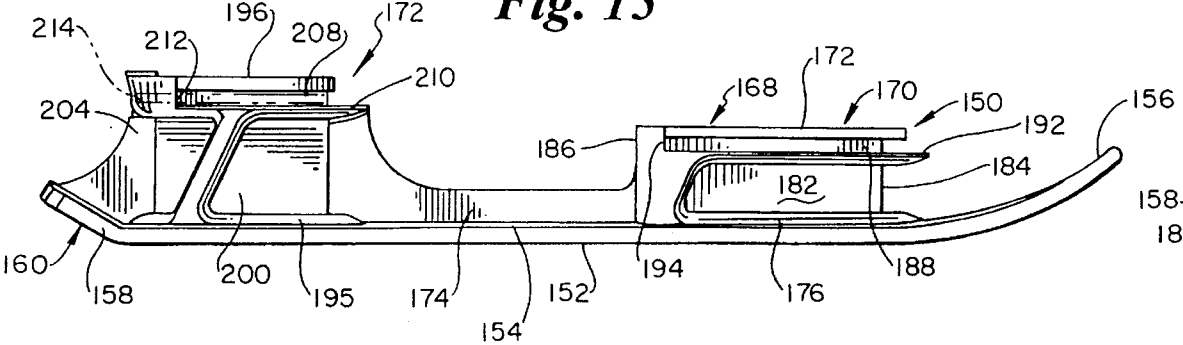
FIG. 15 is an elevational view of the ski with the integral mounting structure.

Referring to FIGS. 13, 14 and 15, a mounting structure 168 complimentary to the frame (frame members 40, 42) carried by the boot 22 for removably attaching the ski 150 to the boot 22 is on the top surface 154 of the ski 150. Preferably, the mounting structure 168 is molded integrally with the body of the ski 150, but it may be permanently or semi-permanently attached to the ski 150 by means such as suitable fasteners (screws, rivets and the like), adhesives or a combination thereof. The mounting structure 168 includes upstanding, generally columnar front and rear mounting structures 170, 172, respectively. A central upstanding spine 174 extends between the front and rear mounting structures 170, 172 generally along the longitudinal axis of the ski 150. The spine 174 reinforces the strength and rigidity of the ski 150 and the mounting structure 168.

The front mounting structure 170 is spaced rearwardly from the tip 156 of the ski 150, the front edge of its base 176 being adjacent to the point along the ski axis at which the front portion of the ski 150 begins to curve upwardly. The front mounting structure 170 has an uppermost surface 178, opposite sides 180, 182, a front end 184, a rear end 186 and a pair of relieved or recessed groove regions 188, 190, one on each side. The slot-like groove regions 188, 190 are defined by the uppermost surface 178 and a flange surface 192 parallel to and just below the uppermost surface 178. A stop shoulder 194 is at the rearward end of the groove regions 188, 190.

Figure 16:
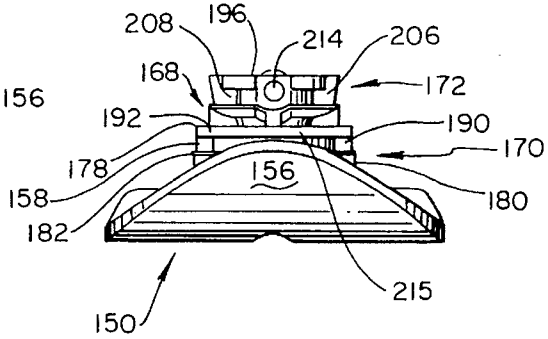
FIG. 16 is a front elevational view of the ski with the integral mounting structure.

With continued reference to FIGS. 13, 14 and 15, the rear mounting structure 172 is located closely adjacent to the rear end 158 of the ski 150. Generally similar to the front mounting structure 170, the rear mounting structure 172 has a base 195, an uppermost surface 196, opposite sides 198, 200, a front end 202, a rear end 204 and a pair of relieved or recessed groove regions 206, 208, one on each side. The slot-like groove regions 206, 208 are defined by the uppermost surface 196 and a flange 210 parallel to and just below the uppermost surface 196. A stop shoulder 212 is at the rearward end of the groove regions 206, 208. Unlike the front mounting structure 170, the rear structure 172 includes a through bore 214 for receiving a fastener (e.g., allen bolt 86, as shown in FIG. 2) for securely locking the ski 150 onto the boot 22. At the front end 202 of the rear mounting structure 172, the flange 210 has a slot 215 for accommodated the fastener. Referring particularly to FIGS. 15 and 16, relative to the top surface 154 of the ski 150, the rear mounting structure 172 is taller than the front structure 170, i.e., the uppermost surface 196 of the rear mounting structure 172 is above, and parallel to, the uppermost surface 178 of the front structure 170. This relationship correlates to the angle built into the boot 22 and enables ergonomic and proper biomechanical skating and skiing motions.

Figure 17:
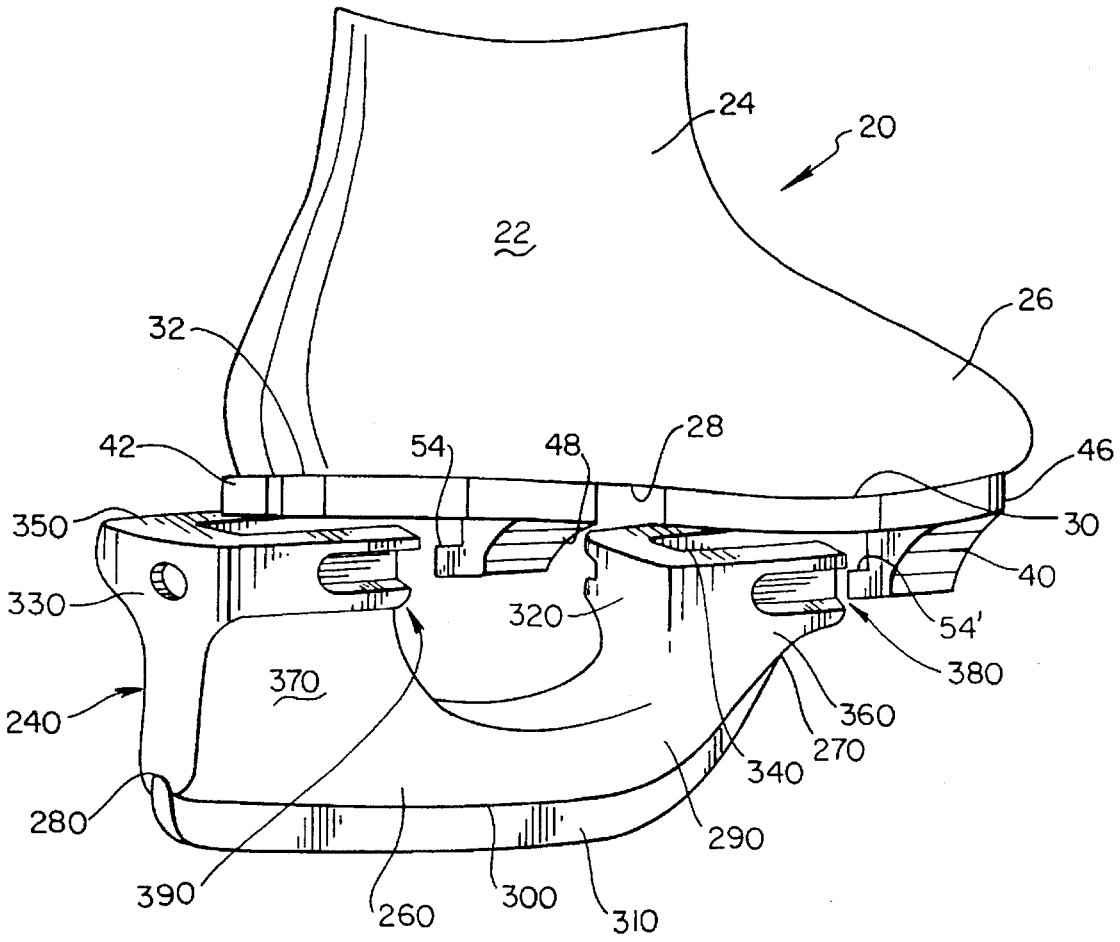
FIG. 17 is a perspective view of the convertible skate of the present invention depicting the blade carrying truck in a disengaged position with respect to the boot.

As depicted in FIG. 17, the present invention includes an bladed truck 240 including a molded polymeric (e.g., nylon or urethane) frame 260 having a front end 270, a rear end 280, a lower portion 290 having a bottom surface 300 from which downwardly projects means in the form of an ice blade 310 for affording rapid movement of the convertible skate 20 along a substrate such as a sheet of ice, and spaced front and rear upper portions 320 and 330. Each of the upper portions 320 and 330 includes a wall with an outer surface and an inner surface defining a central cavity opening through its upper or uppermost surface 340 or 350, which wall has opposite spaced side wall portions 360 or 370, projects upwardly away from lower portion 290, and has front ends adjacent the front end 270 of the frame 260 and rear ends adjacent the rear end 280 of the frame 260. The front and rear upper portions 320 and 330 of the bladed truck 240 each have a mounting structure 380, 390, respectively, which is substantially similar to the front and rear mounting structures 170, 172 of the mounting structure 168 depicted in FIGS. 13–15.

Any suitable material, such as appropriate polymers, plastics or fiberglass may be used to form all or a portion of the boot and the interchangeable truck bodies for carrying and supporting the wheels, blade or ski of the present invention, provided that the selected material is sufficiently strong and light. The latch mechanism 120 for the ski assembly embodiment may take the form of a spring-loaded detent system or a typical ski binding system. Additionally, it may be modified to provide an automatic safety release or kick-off mechanism for the ski 62, although unlike typical downhill ski binding releases, such a mechanism should be difficult to release because the short skis of the present invention are intended for "hotdog" skiing and are less likely to injure the user in a fall. The skis for use in the present invention may be of selected length depending upon the skill of the user and the desired performance characteristics of the skate. Ideally they are shorter than typical downhill skis, but longer than the boot 22. The wheel and blade trucks for use in the ice skate and roller skate configuration of the present invention preferably are the type disclosed in U.S. Pat. No. 4,932,675, the disclosure of which patent is incorporated herein by reference.

Although a description of the preferred embodiment of the present invention is presented, various changes, including those mentioned above, could be made without deviating from the spirit of the present invention. It is therefore desired that reference be made to the appended claims rather than to the foregoing description to indicate the scope of the invention.

What is claimed is:

1. A convertible skate comprising a boot having a sole carrying front and rear attachment members each having a pair of facing, outstanding portions, and a wheeled truck, a bladed truck and a ski, each including a mounting structure complimentary to said front and rear attachment members for selectively and interchangeably mounting the wheeled truck, the bladed truck and the ski on the boot so the skate may be used respectively as a roller skate, an ice skate or a snow skate, said mounting structure comprising front and rear mounting structures each having an uppermost surface, outer sides, front and rear ends and a relieved region on each outer side for receiving the facing, outstanding portions of said front and rear attachment members, respectively.

2. A convertible skate comprising a boot with a sole carrying front and rear attachment members each having a pair of facing, outstanding portions, and a first truck carrying wheels, a second truck carrying a blade and a third truck carrying a ski, each truck including a mounting structure complimentary to said front and rear attachment members for selectively and interchangeably mounting the first, second and third trucks on the boot so the skate may be used respectively as a roller skate, ice skate or snow skate, said mounting structure comprising front and rear mounting structures each having an uppermost surface, sides, front and rear ends and a relieved region the sides for receiving the outstanding portions of said front and rear attachment members, respectively.

3. The skate according to claim 2, wherein the front and rear mounting structures of each truck are substantially identical with respect to those of the other trucks.

4. The skate according to claim 2, wherein, when one of the first, second and third trucks is attached to the boot, a portion of the respective wheels, blade and ski closest to the sole of the boot is spaced from the sole.

5. The skate according to claim 3, further comprising a threaded fastener for releaseably securing any selected one of the wheeled truck, blade carrying truck and ski carrying truck to the boot.

6. A skate assembly for forming a snow skate including a ski carried by a boot, said skate assembly comprising:

front and rear attachment portions having front and rear ends, and opposite side surfaces extending between said front and rear ends, said attachment portions attached respectively to the sole and heel of the boot with the front ends of the attachment portions adjacent the front end of the boot; and an elongate sub-assembly integral with the ski and including a molded polymeric frame having a front end and a rear end, said frame including:

a middle portion extending between said front and rear ends and spaced front and rear portions each having an uppermost surface, opposite spaced side wall portions, and front and rear ends;

means for releasably engaging said rear portion to said rear attachment portion and said front portion to said front attachment portion comprising, for each pair of engagable portions, a pair of grooves extending from an inlet adjacent one of the ends of the front and rear portions toward the other of the ends of the portions, each groove extending along a different one of the side surfaces of said portions; and said attachment portions having at least one part adapted to extend along said side surfaces of said side wall portions and including a pair of tongues having opposite upper and lower surfaces and distal surfaces extending from one of the ends of the attachment portion toward the other of the ends of the attachment portions, each tongue adapted to enter a different one of said grooves from said inlet to an engaged position with said surfaces of said grooves and tongues in frictional engagement; and fastening means for fixing said sub-assembly to said boot including a fastening member attached to one of said portions.

7. An assembly for attaching a ski to a boot, said assembly comprising:

front and rear attachment portions having front and rear ends, and opposite side surfaces extending between said front and rear ends, said attachment portions being attached respectively to a sole and heel portion of the boot; and an elongate sub-assembly having a front end and a rear end, said elongate sub-assembly integral with the ski and including:

a middle portion extending between said front and rear ends and spaced front and rear portions each having an uppermost surface, opposite spaced side wall portions, and front and rear ends;

means for releasably engaging said rear portion to said rear attachment portion and said front portion to said front attachment portion comprising, for each pair of engaged portions, a pair of grooves extending from an inlet adjacent one of the ends of the front and rear portions toward the other of the ends of the portions, each groove extending along a different one of the side surfaces of said portions; and said attachment portions having at least one part adapted to extend along said side surfaces of said side wall portions and including a pair of tongues having opposite upper and lower surfaces and distal surfaces extending from one of the ends of the attachment portion toward the other of the ends of the attachment portions, each tongue adapted to enter a different one of said grooves from said inlet to an engaged position with said surfaces of said grooves and tongues in frictional engagement; and fastening means for fixing said sub-assembly to said boot including a fastening member attached to one of said portions.

8. The assembly according to claim 7, wherein the ski has a longitudinal axis and the middle portion is generally parallel to said axis.

* * * * *